United States Patent [19]

Leonard

[11] 4,152,971

[45] * May 8, 1979

[54] FLUIDIC REPEATER

[76] Inventor: Willie B. Leonard, 5902 Royalton, Houston, Tex. 77036

[ * ] Notice: The portion of the term of this patent subsequent to Nov. 2, 1993, has been disclaimed.

[21] Appl. No.: 720,420

[22] Filed: Sep. 3, 1976

Related U.S. Application Data

[60] Division of Ser. No. 521,036, Nov. 5, 1974, Pat. No. 4,046,059, which is a continuation-in-part of Ser. No. 489,829, Jul. 18, 1974, Pat. No. 3,988,966.

[51] Int. Cl.[2] ..... F15B 13/16; F15B 15/22

[52] U.S. Cl. ..... 91/388; 91/402; 91/461; 137/625.6

[58] Field of Search ..... 91/388, 402, 47; 137/625.63, 625.6, 625.62

[56] References Cited

U.S. PATENT DOCUMENTS

| | | | |
|---|---|---|---|
| 2,709,421 | 5/1955 | Avery | 137/625.63 |
| 2,841,168 | 7/1958 | Levetus et al. | 137/625.63 |
| 3,426,258 | 2/1969 | Van Pelt | 91/388 |
| 3,521,535 | 7/1970 | Pelrich | 91/47 |
| 3,543,648 | 12/1970 | Stahle | 137/625.62 |

*Primary Examiner*—Paul E. Maslousky

*Attorney, Agent, or Firm*—Murray Robinson; Ned L. Conley; Russell D. Weaver

[57] ABSTRACT

Two fluid passages are connected through flow restrictors to a fluid supply. Downstream of the restrictors the fluid supply has a drooping pressure-load characteristic. Venting means for the fluid passages comprises vent openings therein downstream of the restrictors and variable position obstructor means cooperating with vent openings to vary venting and thereby vary fluid pressures in the fluid passages.

Fluid conduits connect these pressure outputs to a fluid to mechanical translator comprising a double acting piston moving in a cylinder whose opposite ends are connected to the fluid conduits. The piston and cylinder form the responder of the system, which may be adjacent the mechanical to fluidic translator and form part of the transmitter.

A feed back means controlled by the position of the responder piston and/or the load varies pressure in the fluid conduits by variably venting same.

Instead of variable venting, variable pressures can be generated by making the restrictors variable and conducting the downstream pressure by two lines to the responder. Furthermore, the transmitter may be modified to effect change in only one pressure. A single line may then be used between transmitter and responder.

21 Claims, 31 Drawing Figures

Fig. 23
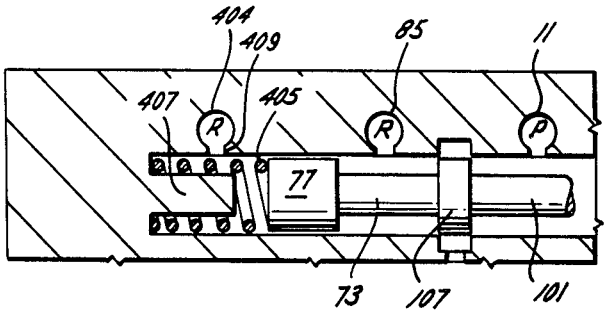
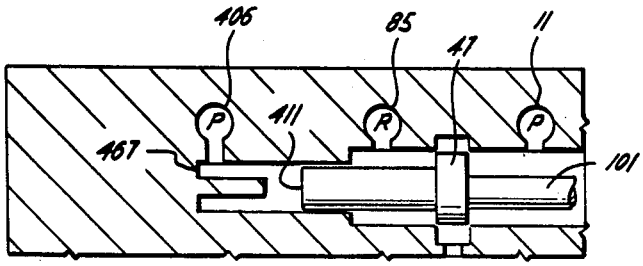
Fig. 24
Fig. 25
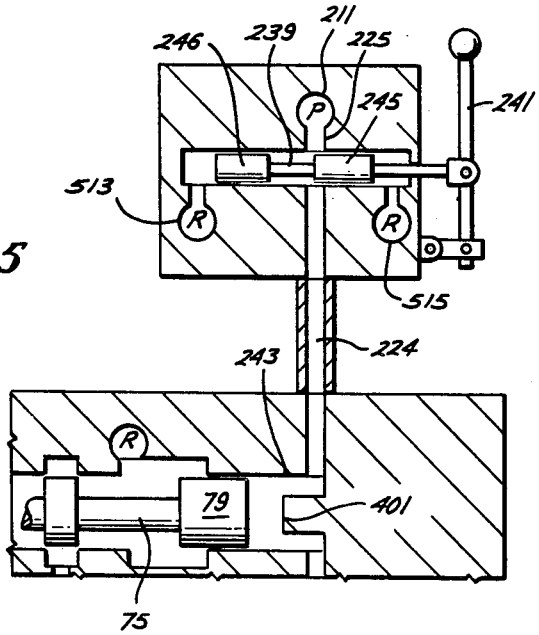

27
27
602
604
606
608
610
612
614
618
620
622
624
626
628
630
632
634
636
638
640
642
643
644
646
648
650
652
654
656

31
31

FLUIDIC REPEATER

CROSS REFERENCES TO RELATED APPLICATIONS

This is a division of application Ser. No. 521,036, filed on Nov. 5, 1974, now U.S. Pat. No. 4,046,059, which is a continuation-in-part of application Ser. No. 489,829, filed on July 18, 1974, now U.S. Pat. No. 3,988,966.

BACKGROUND TO THE INVENTION

This invention pertains to fluidic, e.g. hydraulic or pneumatic, repeaters useful as remote indicators and servo proportional controllers for either amplification or remote operation, e.g. in seismic generators, aircraft controls, boat steering, automobile wheel tracking, plow jerkers, and vibration test equipment.

Hydraulic devices employing mechano-hydraulic transmitters including an obstructor moving relative to two liquid parts connected to a liquid supply having a drooping pressure-load characteristic are known. It is also known to employ as a receiver a double acting piston moving in a cylinder whose ends are connected by fluid conduits to the transmitter liquid supply upstream of the transmitter parts and to connect the piston mechanically or hydraulically to an output. Various feedbacks from the output to the transmitter are also known.

SUMMARY OF THE INVENTION

According to the invention means for feedback control, whether incorporated directly in the double acting piston or mechanically connected thereto, comprises variable cross-section surface passages, e.g. tapered grooves. These grooves may be in the ends of a double acting piston cooperating with ports or side recesses of a cylinder. The piston moves to variably throttle fluid vented from the high pressure ends of the piston to lower pressure portions of the system. The invention further includes improved transmitter, responder and receiver means useful with the feedback means of the invention, e.g. systems in which the transmitter has a single line output for actuating the responder or receiver, systems in which the transmitter operates by variable throttling, and systems employing rotary type transmitters and systems with rotary type feedback means. Other features of the invention and objects and advantages thereof will appear hereinafter.

BRIEF DESCRIPTION OF THE DRAWINGS

For a more detailed description of several preferred embodiments of the invention reference will now be made to the accompanying drawings wherein:

FIG. 23 is a fragmentary schematic sectional view of a portion of an embodiment of the invention;

FIG. 24 is a view similar to FIG. 23 showing a portion of another embodiment;

FIG. 25 is a fragmentary, largely schematic sectional view showing a portion of an embodiment of the invention;

DESCRIPTION OF PREFERRED EMBODIMENTS

Figure 1:
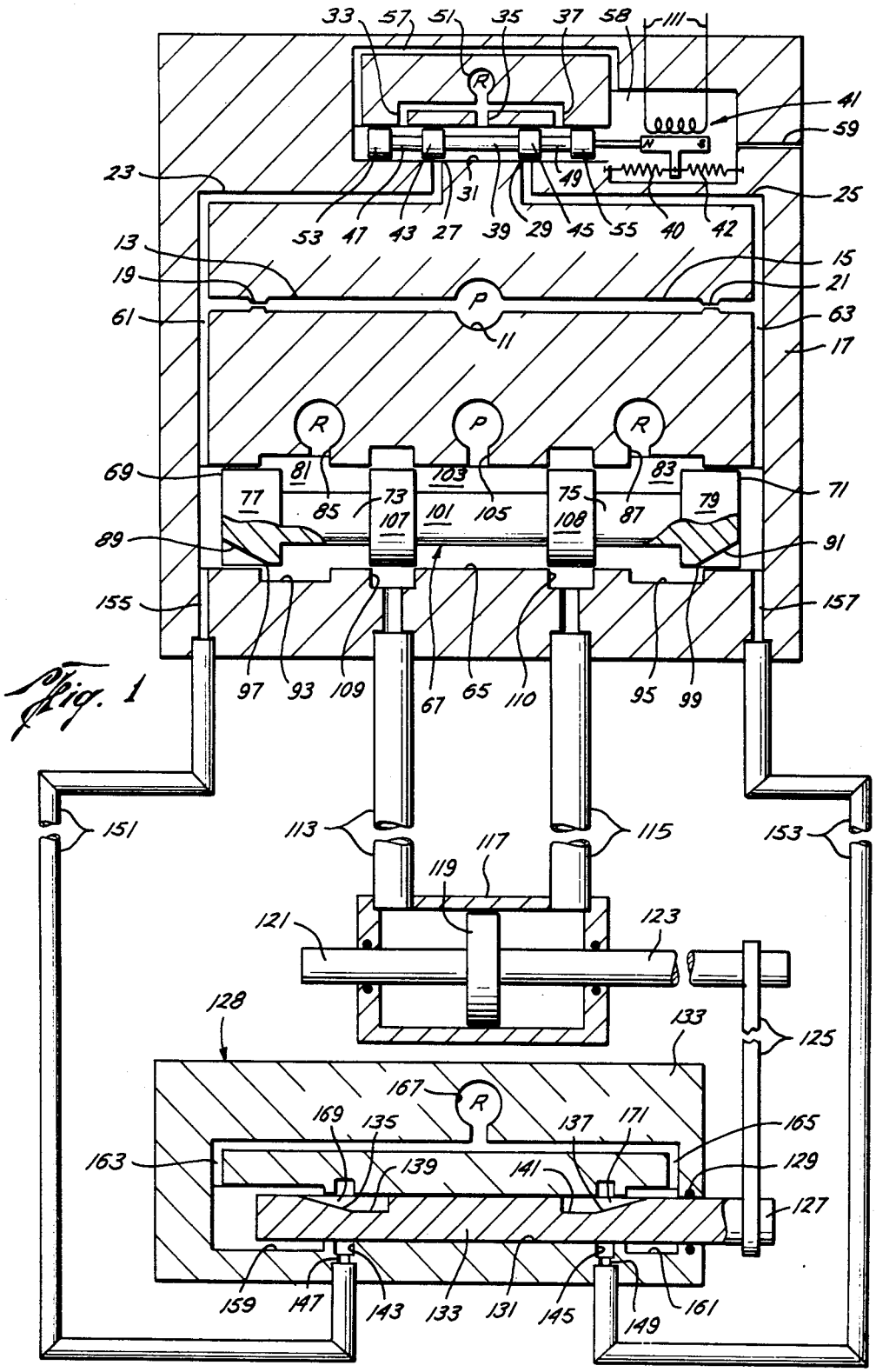
FIG. 1 is a largely schematic sectional view illustrating a fluidic repeater according to the referred embodiment of the invention.

Referring now to FIG. 1, a fluidic repeater comprises a pump or source (not shown) of fluid under pressure connected to conduits marked P and a sump or low pressure fluid reservoir (not shown) connected to conduits marked R. Usually the system will be hydraulic and use a liquid, e.g. mineral oil, as working fluid, but the following description refers to all embodiments of the invention and is also applicable to pneumatic systems wherein a gas, e.g. air, is the system fluid.

Fluid from pressure source conduit 11 flows through passages 13, 15 in transmitter body 17, through restrictions or orifices 19, 21 to passages 23, 25, and thence out through ports 27, 29. The ports empty into the interior of cylinder 31 formed in transmitter body 17. Cylinder 31 is vented to reservoir 51 by three ports 33, 35, and 37. A four landed spool 39 is moved axially back and forth in cylinder 31 by electromagnetic solenoid 41, which may also be a short stroke torque motor. The solenoid is biased to its midposition, as shown, by springs 40 and 42. When spool 39 is biased to mid position, as shown in FIG. 1, lands 43 and 45 fully or substantially block ports 27 and 29. This reduces the transmitter's idle power requirements. In a modulating system both ports will be partially open in the mid-position of the spool.

Operationally, electric signals applied to solenoid or electric motor 41 moves spool 39 toward one end of cylinder 31. This opens either port 27 or 29 an amount whose magnitude is dependent upon the spool's movement. In a modulating system, the port not opened will be closed an amount also dependent upon the spool's axial movement. As one port is opened, e.g. port 27, pressure in passage 23 drops due to the increased fluid flow from the source through the flow restrictor or orifice 19, while closure of the other port, e.g. port 29, will cause a pressure rise in passage 25 due to the reduced flow through orifice 21. Flow passage 13 with orifice 19 and the flow passage 15 with orifice 21 thus provide fluid supplies of drooping pressure-load characteristics. Connected to this supply are ports 27, 29, and spool 39 with lands 43, 45. These provide a variable obstructor for opening and closing the ports this variably venting the fluid supplies to provide variable pressure outputs that vary in accordance with the obstructor's position. Since obstructor position is controlled by an electric motor, the system thus far detailed provides an electrofluidic transducer transmitter.

To prevent hydraulic locking of spool 39 because of the inherent slight leakage past lands 43 and 45, the spools are relieved by providing annular spaces 47 and 49 beyond lands 43 and 45 that communicate with ports 33 and 37. These ports lead to conduit 51 that is connected to the reservoir. Spool 39 is provided with additional guidance by providing it with end lands 53 and 55. The ends of cylinder 31 are connected by fluid passage 57 that leads to chamber 58. Chamber 58 contains motor 51 and is vented to the atmosphere by passage 59.

The transmitter's varying fluid pressure outputs are conducted by fluid passages 61 and 63 to an amplifier comprising cylinder 65 formed in transmitter body 17. A double acting free piston 77 floats in cylinder 65, being free to move axially in response to pressure differentials at its ends 69, 71. Fluid passages 61, 63 from the transmitter are connected to the ends of cylinder 65 so their pressures can act on the free piston's ends. The outer periphery of the piston is relieved by annular grooves 73 and 75, leaving lands 77 and 79 at the ends of the piston. Annular spaces 81 and 83 formed by grooves 73 and 75 are vented to the reservoir by fluid passages 85, 87. Lands 77 and 79 are provided with sloping grooves 89 and 91, respectively, whose depth decreases progressing from the ends of the piston toward grooves 73 and 75. Sloping grooves 89 and 91 vent pressure fluid from passages 61 and 63 past lands 77 and 79 to recesses 93 and 95 in the cylinders' sides and hence to the reservoir through passages 85 and 87. Suitable means, not shown, such as a key and slot, are provided to maintain grooves 89 and 91 in azimuthal alignment with recesses 93 and 95. The size of vent openings 97 and 99 connecting grooves 89 and 91 with recesses 93 and 95 increase and decrease when piston 67 is moved axially. This venting causes negative feedback to fluid passages 61 and 63. Higher pressure at one of passage 61 or 63 than at the other moves free piston 67 in the correct direction to increasingly vent this higher pressure to a reservoir through either groove 89 or 91. Relatively lower pressure in passage 61 or 63 than in the other moves free piston 67 in a direction to reduce venting of such lower pressure to the reservoir. Due to this variable negative feedback, piston 67 moves proportionally in response to the degree of movement of spool 39 and then comes to rest.

Free piston 67 could be connected mechanically to a suitable output such as an indicator, valve or other load. Cylinder 65 and piston 67 would then constitute parts of a receiver connected to the previously described transmitter. Passages 61 and 63 could be replaced by hoses, pipes, or other extended fluid conduits. The system would then constitute a remote indicating or proportional control system.

As shown in FIG. 1, however, piston 67 and cylinder 65 form parts of a fluidic amplifier. Piston 67 is relieved at its mid portion by annular groove 101. Annular space 103 formed by groove 101 is connected by fluid passage 105 leading to a source of fluid pressure. Lands 107 and 108 between groove 101 and grooves 73 and 75, cover outlet ports 109 and 110 in cylinder 65 when piston 101 is in mid position, as shown. When piston 101 moves axially toward one end of cylinder 65 in response to electric signals supplied to conductors 111 of motor 41, then output ports 110 and 109 are uncovered in proportion to the piston's movement. One fluid conduit (hoses) 113 or 115 is thus connected to a source of pressure fluid through space 103 and passage 105 while the other of conduits is connected to reservoir through either space 81 and passage 85 or space 83 and passage 87. Hoses 113 and 115 are connected to opposite ends of load cylinder 117, which, together with piston 119 therein, forms a remote receiver.

When hose 113 or 115 is connected to the source of pressure fluid and the other to the reservoir, piston 119 moves in the direction of the flow from high pressure to low pressure. Piston rods 121, 123 extend through opposite ends of the cylinder 117, leaving equal areas of piston 119 exposed to pressures in cylinder 117. Piston rod 123 is extended to connect to a mechanical load, e.g. a valve, not shown.

Piston rod 123 is also connected mechanically by bar 125 to stem 127 of feedback valve 128. For easier viewing, valve 128 is drawn to a larger scale than load cylinder 117, but it is to be understood that the areas exposed to fluid pressure in the feedback valve are negligibly small compared to those of load cylinder 117.

Stem 127 extends through sealed opening 129 into cylinder cavity 131 of valve body 163 and connects to cylindrical valve closure 133. Closure 133 is provided with two sloping grooves 135 and 137 of increasing depth progressing axially from the ends toward the midportion of the closure. The deepest portions of the grooves being continued axially at constant depth for a certain extent as shown at 139 and 141. When the closure 133 is in midposition, as shown in FIG. 1, sloping portions of grooves 135 and 137 are in register axially with annular recesses 143 and 145 in the sides of cylindrical cavity 131. Recesses 143 and 145 communicate with ports 147 and 149, respectively, which, in turn, are connected to fluid conduits (hoses) 151 and 153. Conduits 151 and 153 are connected to ports 155 and 157, respectively, leading to the ends of amplifier cylinder 65.

The ends of cylindrical valve body cavity 131 are enlarged at 159 and 161 providing annular spaces communicating both with grooves 135 and 137 and also with passages 163 and 165 leading to conduit 167 connecting with the reservoir. When closure 133 moves axially, openings 169 and 171 between grooves 135 and 137 and the sides of cylindrical valve body cavity 131 are opened or closed in proportion to the degree of axial movement. This increases the venting to the reservoir of one of the feedback conduits 151, 153 and decreasing the venting of the other.

Operationally, when a pressure differential across the ends of amplifier piston 67 causes the piston to move right or left, then load piston 119 moves in the opposite direction carrying with it attached feedback valve closure 133. This creates a pressure differential between conduits 151 and 153 opposite to that across piston 67. The feedback from feedback valve 128 is therefore negative and tends to cancel out the pressure differential caused by movement of spool 39. This cancellation causes piston 101 to return to neutral or midposition. This discontinues the pressure differential across load piston 119, which then comes to rest in a displaced position proportional to the displacement of spool 39 that in turn was proportional to the signal strength applied to motor 41 at input 111.

Although motions of the various parts; e.g. transmitter spool 39, amplifier piston 101, load piston 119, and feedback valve closure 133; have been said to be proportional to the signal applied to the input 111 of motor 41, this is to be understood to mean only that there is a direct function between signal amplitudes and mechanical positions with an increase in signal strength causing an increase in mechanical travel. However, by appropriately shaping grooves 89, 91, 135 and 137, the proportionality may be made to approach closely a linear function. Other groove shapes than the simple sloping grooves 89, 91, 135 and 137 may be employed.

Figure 2:
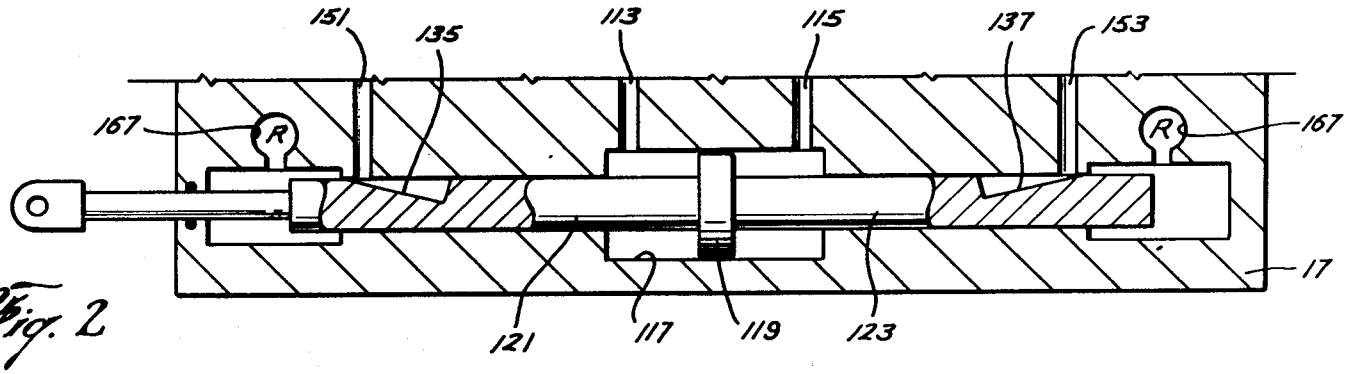
FIGS. 2 and 3 are fragmentary views similar to FIG. 1 showing modifications.
Figure 3:
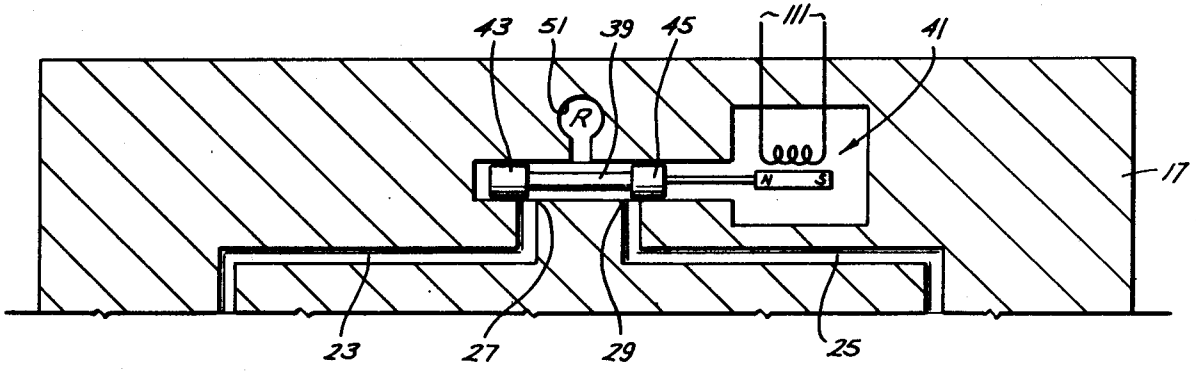

Referring now to FIGS. 2 and 3 there are shown modifications of the FIG. 1 construction. FIGS. 2 and 3 show only a portion of the apparatus shown in FIG. 1; the remainder of FIGS. 2 and 3's apparatus being the same as that of FIG. 1. Parts that are the same as those in FIG. 1 are given like reference numbers and their description will not be repeated. An examination of FIG. 3 will reveal that whereas in FIG. 1 lands 43 and 45 are disposed so as to substantially block ports 27 and 29 when spool 39 is in midposition; in FIG. 3 lands 43 and 45 are disposed to leave both ports 27 and 29 partly open when spool 39 is in midposition.

FIGS. 2 and 3 differ from the FIG. 1 construction in two additional respects. First, guide lands 53 and 55 are omitted from spool 39, as are leakage return ports 33 and 37 and atmosphere vent passages 57 and 59. These of course can be used wherever it is found necessary or desirable. Secondly, and most important, in FIGS. 2 and 3 separate feedback valve 128 is omitted. Instead feedback valve means comprising grooves 135 and 137 controlling fluid conduits 151 and, respectively, 153 are provided directly on the ends of valve stems 121 and 123.

Figure 4:
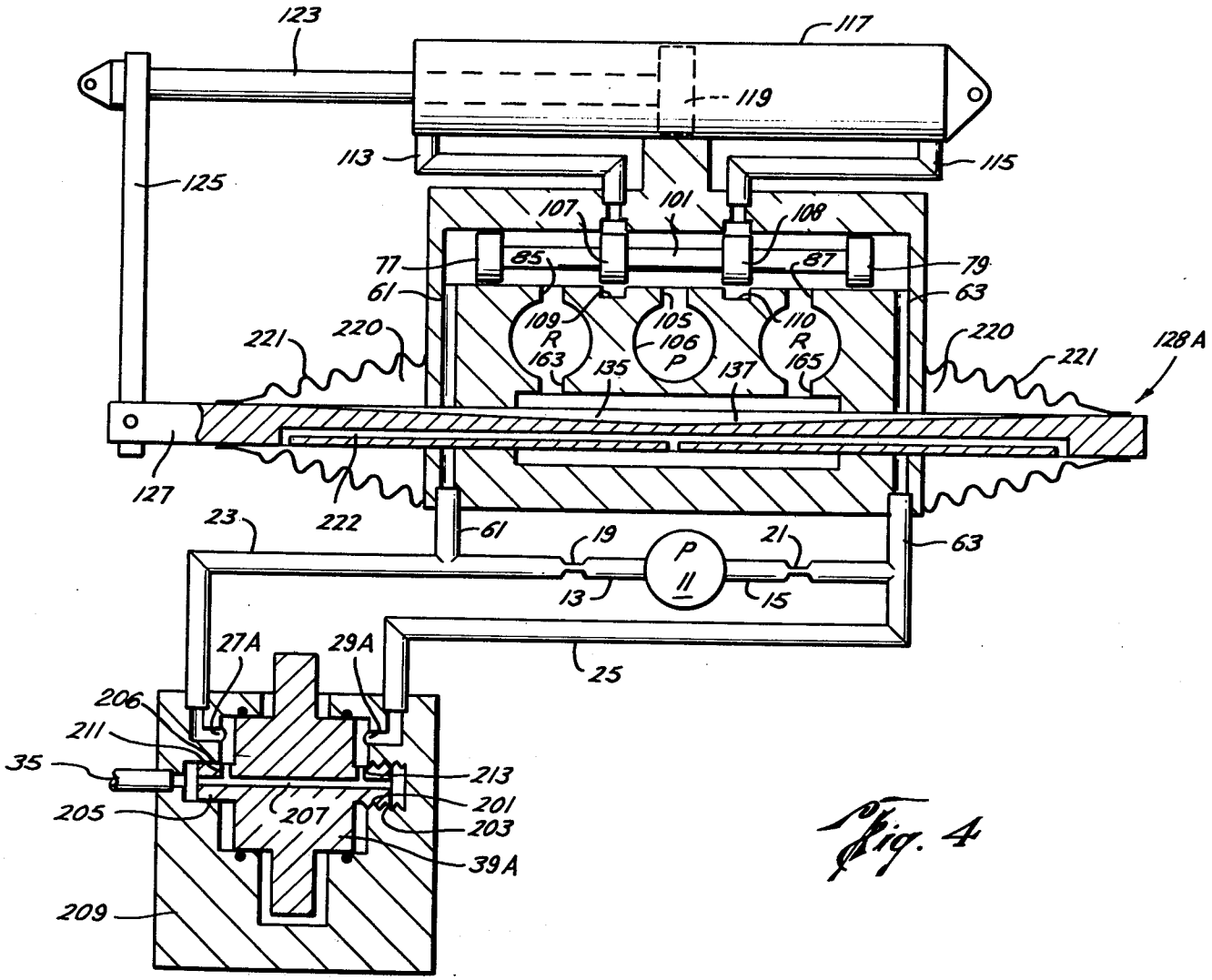
FIGS. 4 and 5 are views similar to FIGS. 1–3 showing two further modifications.

Referring now to FIG. 4 there is shown another modification of the FIG. 1 system. Again like parts are given like reference numbers and will not again be described.

The primary difference between the embodiments of the invention shown in FIGS. 1 and 4 is that in FIG. 4 the spool controlled ports 27 and 29 of FIG. 1 are replaced by nozzles 27A and 29A whose flow is controlled by obstructor 39A. The latter is a hand operated wheel, as distinguished from the electric motor actuated spool 39 of FIG. 1. Bearing 201 at one side of cylindrical obstructor 39A is internally threaded to receive threaded pin 203 on which the obstructor pivots. As the obstructor is rotated it moves axially approaching one or the other of nozzles 27A or 29A and moving farther away from the nozzle not approached. By this means the fluid pressure in conduits 23 and 25 is varied. Obstructor 39A is provided with unthreaded pivot pin 205 received in bearing 206 in obstructor support body 209. Nozzles 27A and 27B discharge into the interior of body 209. Radial passages 211 and 213 in pins 203 and 205, respectively communicate with the interior of body 209 and connect with axial fluid passage 207 which discharges into return line 35 leading to the fluid reservoir.

Another difference between the construction of FIGS. 1 and 4 lies in the construction of the feedback valve 128A that is mechanically linked to load piston rod 123.

Feedback valve 128A variably vents fluid passages 61 and 63 via grooves 135 and 137, which, in this case, are connected together to form one long groove. Venting through grooves 135 and 137 can also be outwardly into the spaces 220 inside annular sealing boots 221 and thence through groove 222 back to the reservoir. When feedback valve 128A has moved far enough to equalize the pressure in fluid passages 61 and 63, piston 101 moves back to neutral position. Load piston 119 remains in its new postion as controlled by the setting of manual obstructor 39A.

Another difference between the embodiments of FIGS. 1 and 4 lies in the fact that in the FIG. 4 construction the amplifier piston 101 is not provided with feedback grooves in its ends like the grooves 89 and 91 of the FIG. 1 embodiment.

Figure 5:
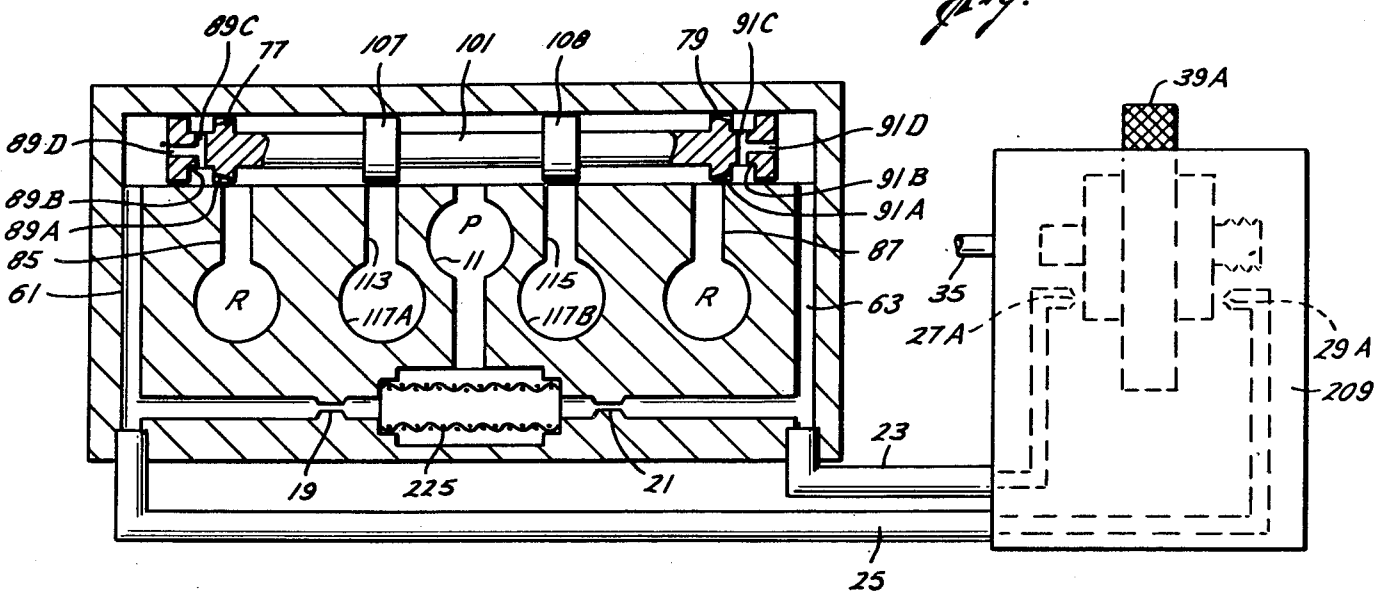
Figure 7:
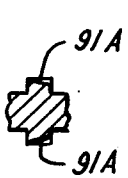
Figure 6:
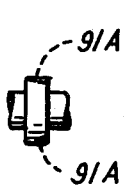

Referring now to FIG. 5 there is shown a further embodiment similar to the embodiments of FIGS. 1–4 wherein like reference numbers refer to like parts that will not be redescribed. As in the FIG. 4 construction, the FIG. 5 embodiment includes a manually activated hand wheel type obstructor 39A cooperating with nozzles 27A and 29A, rather than an electric motor activated spool 39 cooperating with ports 27 and 29 as in FIGS. 1–3. However, as in FIGS. 1–3, the amplifier piston is provided with feedback means. In the FIG. 5 construction instead of providing the ends of amplifier piston 101 with sloping grooves as at 89, 91 extending all the way to the outer ends of the piston as in FIGS. 1–3, the sloping grooves 89A and 91A of the FIG. 5 construction terminate where they run into and communicate with annular grooves 89B and 91B around the lands 77 and 79 respectively. Grooves 89B and 91B in turn communicate with the piston's ends via radial and axial flow passages 89C, 89D and 91C, 91D. Shape of grooves 89A and 91A is shown more clearly in larger scale detail views of FIGS. 6, 7 and 8. Short grooves 89A and 91A cooperate with annular grooves 89B and 91B to provide non-linear feedback correlative to the non-linear input of nozzle obstructor 39A. This effects a more nearly linear proportionality between hand wheel movement and amplifier piston movement.

Figure 9:
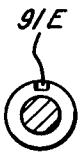
FIG. 9 is a view similar to FIG. 8 showing another embodiment.
Figure 8:
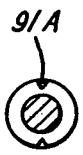
FIGS. 6, 7, and 8 are elevational, sectional and end views respectively of the end of the amplifier piston of the FIG. 5 embodiment.

FIG. 9 shows feedback groove 91E of rectangular cross section as an alternative to the V-shape cross section of groove 91A of FIG. 8.

No load cylinder and piston are shown in the FIG. 5 construction, but it is to be understood that amplifier output passages 113 and 115 connect via passages 117A and 117B leading to a suitable load cylinder which usually will be provided with further feedback means as in FIGS. 1–4. Without a load feedback the load piston will ultimately move to the limit of its travel regardless of the magnitude of the input at obstructor 39. The rate of this movement of the load piston will vary in proportion to the magnitude of the input at obstructor 39A. In some applications the load feedback means of the FIGS. 1–4 embodiments could also be omitted.

FIG. 5 illustrates the use of a filter screen 225 between conduit 11 leading to the source of pressure fluid and the orifices 19 and 21. This is desirable to prevent blockage of the orifices by foreign matter. This constructional detail, though not shown in FIGS. 1–4, is to be understood as being applicable to all embodiments of the invention.

Figure 10:
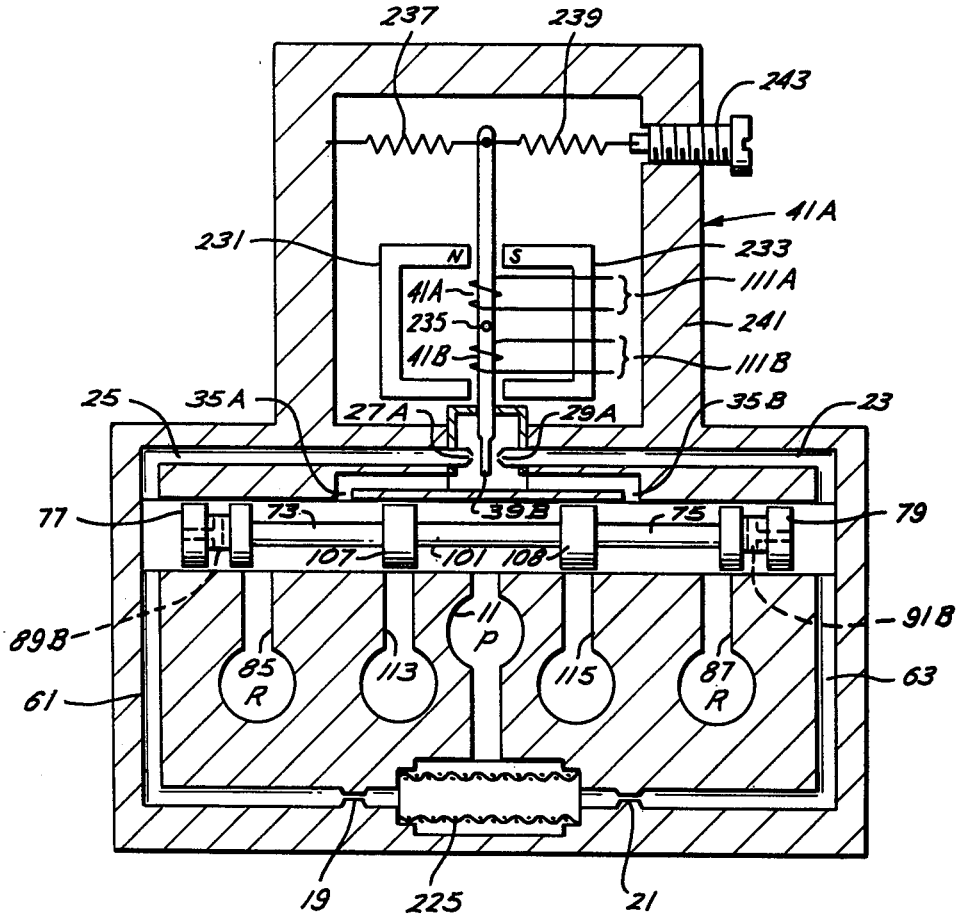
FIG. 10 is a cross-sectional schematic view of a mechanical to fluidic translator according to the invention.

FIG. 10 shows an embodiment of the invention that is much the same as that of FIG. 5. Differences include modification of the feedback groove system in the amplifier piston and the use of an electric "flapper" in place of hand wheel obstructor 39A. Like parts are given like reference numbers and their description will not be repeated.

The amplifier piston feedback groove system in FIG. 10 is similar to the system illustrated by FIG. 5 except short sloping grooves 89A and 91A are omitted. An initial axial motion of the piston 101 sufficient to communicate annular groove 89B or 91B with vent passage 85 or 87 is required before any feedback will occur. Thereafter, further embodiment of the piston 101 in the same direction will cause increasing venting.

Figure 11:
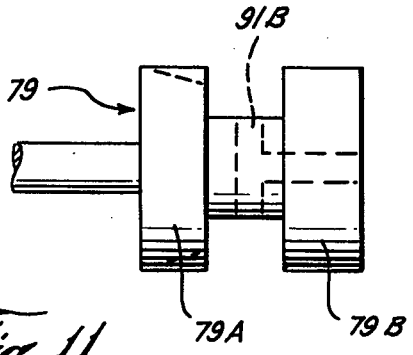
FIG. 11 is a sectional view of part of the spool valve shown in FIG. 10.

If desired, lands 77 and 79 can be inwardly flaring or tapered, e.g. conically or in other manner annularly relieved between annular grooves 73 and 89B along one end and between annular grooves 75 and 91B at the other end, as shown in FIG. 11. This will effect a result similar to that attained by the embodiment illustrated in FIG. 5. The outermost parts of the lands will be cylindrical, for guide purposes, as shown at 79B.

Electric flapper 41A shown in FIG. 10 driving flapper type obstructor 39B includes horseshoe magnets 231 and 233 disposed opposite pole to opposite pole with flapper 39B pivoted therebetween at 235. Tension springs 237 and 239 are connected to one end of the flapper and to motor housing 241 and adjustment screw which 243 normally centers the other end of the flapper between nozzles 27A and 29A. When an electric signal is applied to either input 111A or 111B of solenoid 41A or 41B the flapper is magnetized a proportional amount. This moves it toward or away from nozzle 27A or 29A. This variably vents passages 23 and 25. Fluid leaving nozzles 27A and 29A returns to the fluid reservoir through passages 35A and 35B.

Figure 14:
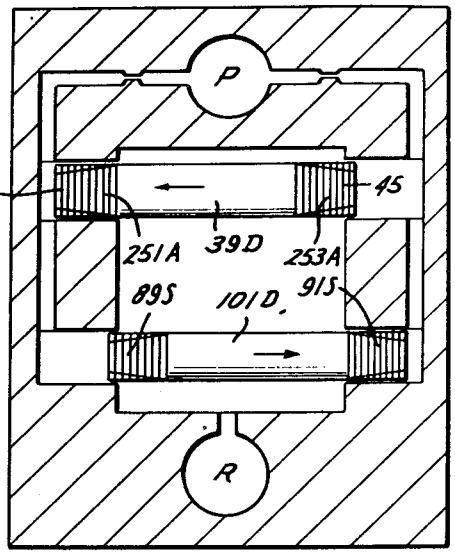
FIGS. 12, 13 and 14 are largely schematic sectional views showing further embodiments of the invention.
Figure 13:
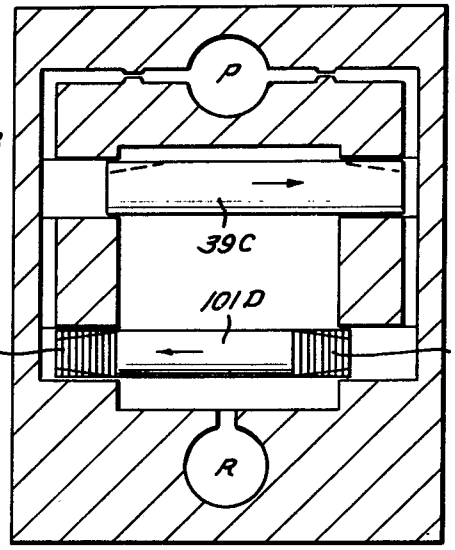
Figure 12:
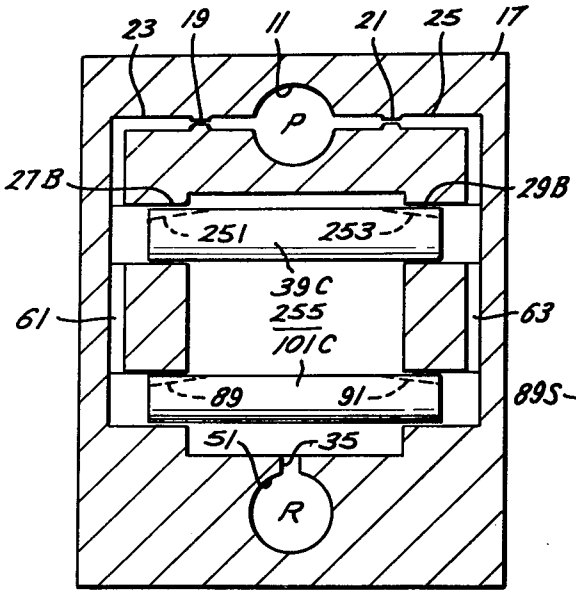

FIGS. 12–14 show rudimentary fluidic repeater apparatus according to an embodiment of the invention in which transmitter obstructor 39C or 39D is of the needle valve type rather than the spool valve type shown in FIGS. 1–3 or the jet interference types shown in FIGS. 4, 5, and 10. In FIG. 12 obstructor 39C is a cylindrical plug axially movable relative to cylindrical ports 27B and 29B. Plug 39C is provided with sloping grooves 251 and 253 similar to grooves 89 and 91 of the amplifier piston of FIG. 1. According to the axial position of plug 39C more or less fluid is vented from fluid source passages 23 and 25 to chamber 255 and then through passage 35 to reservoir return conduit 51. No means for moving plug 39C is shown, but it is to be understood that any suitable means can be used, e.g. any of the manual or motor means used in the previously described embodiments.

Figure 16:
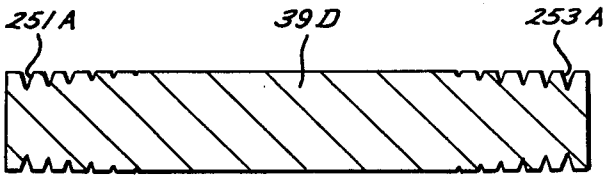
FIGS. 15 and 16 are sectional views of feedback elements of the embodiments shown in FIGS. 12 through 14.
Figure 15:
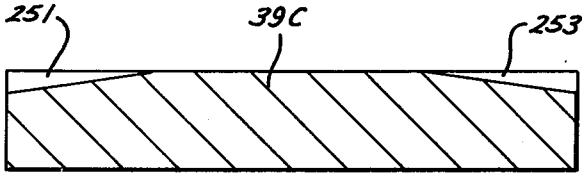

The transmitter obstructor shown in FIG. 13 is the same as that in FIG. 12. The transmitter obstructor shown in FIG. 14 is the same as in FIGS. 12 and 13 except that the ends of the obstructor plug 39D are provided with spiral helical grooves 251A, 253A spiraling inward and progressing axially towards the plug ends, rather than the sloping grooves 251, 253 of the embodiments of FIGS. 12 and 13. The two groove constructions are further illustrated in FIGS. 15 and 16.

Referring once more to FIG. 12, receiver piston 101C is provided with sloping feedback grooves 89 and 91 similar to those shown in the embodiments of FIGS. 1–3 whereby axial motion of piston 101C due to difference in pressure between fluid passages 61 and 63 causes such venting through chamber 255 and passage 35 to reservoir return conduit 51 as to eliminate the pressure differential. The receiver piston constructions of FIGS. 13 and 14 are the same as that of FIG. 12 except that instead of sloping grooves 89 and 91 of configuration like transmitter grooves 251 and 253, the receiver pistons of FIGS. 13 and 14 are provided with spiral helical grooves of configuration similar to the grooves 251A and 253A.

No amplification is effected between transmitter plugs 390 and 39D and receiver pistons 101C and 101D. No loas is shown connected to pistons 101C or 101D, but it is to be understood that they can be connected fluidically to load cylinders and pistons as are the amplifier pistons in the other embodiments, or mechanically, the same as feedback piston 133 in FIG. 1, for example, or pistons 101C and 101D could be connected to indicator or display means of minimum load power requirements.

The various vent groove configurations described herein as applicable to the transmitter plug (FIGS. 15 and 16), the amplifier or receiver piston (FIGS. 1–3, 5–14) and the load feedback piston (FIGS. 1–4) may be interchanged between the various embodiments described hereinabove or hereinafter, as may be desired or required for any reason, for example to correlate the transmitter obstructor position-vent function, the amplifier piston position-vent function, and the load feedback valve position-vent function.

Comparing the several embodiments of the invention thus far described it will be seen that operationally in each case a transmitter obstructor moves relative to a pair of openings. These may be side ports in a spool valve as in FIG. 1, jet nozzles as in FIGS. 4 and 10, or needle valve ports as in FIGS. 12–14. In each case the pair of openings open to some form of chamber means, e.g. a cylinder FIG. 1, cylindrical spaces in a hand wheel block FIG. 4, a chamber in the transmitter block FIG. 10, or a cylindrical chamber FIGS. 12–14. In each case flow from the pair of openings is controlled by some form of barrier means, e.g. piston lands FIG. 1, hand wheel obstructor FIG. 4, flapper FIG. 10, or needle valve plugs FIGS. 12–14. The obstructor and openings provide means to variably vent a pair of pressure fluid passages downstream from flow restrictors. Responder means, e.g. amplifier and/or load cylinders, are connected to the fluid passages. Feedback means from the amplifier and/or load cylinder variably vent the pair of fluid passages opposite to the variation by the obstructor. The feedback means comprises variable cross section surface passages in the amplifier or load or receiver piston or several of these or in the walls of the cylinders surrounding these pistons.

The responder means of the invention can be actuated by other forms of transmitter than those described above in which the transmitter variably vents a pair of fluid passages downstream from flow restrictors therein, the fluid passages upstream from the restrictors leading to a source of constant fluid pressure, and the pressures downstream from the restrictors being conducted by two fluid lines to the responder. Instead of variable venting, variable pressures can be generated by making the restrictors variable and conducting the downstream pressures by two lines to the responder. Furthermore, the transmitter may be modified to affect change in only one pressure. A single line may then be used between transmitter and responder. These various modifications will be described next.

Figure 17:
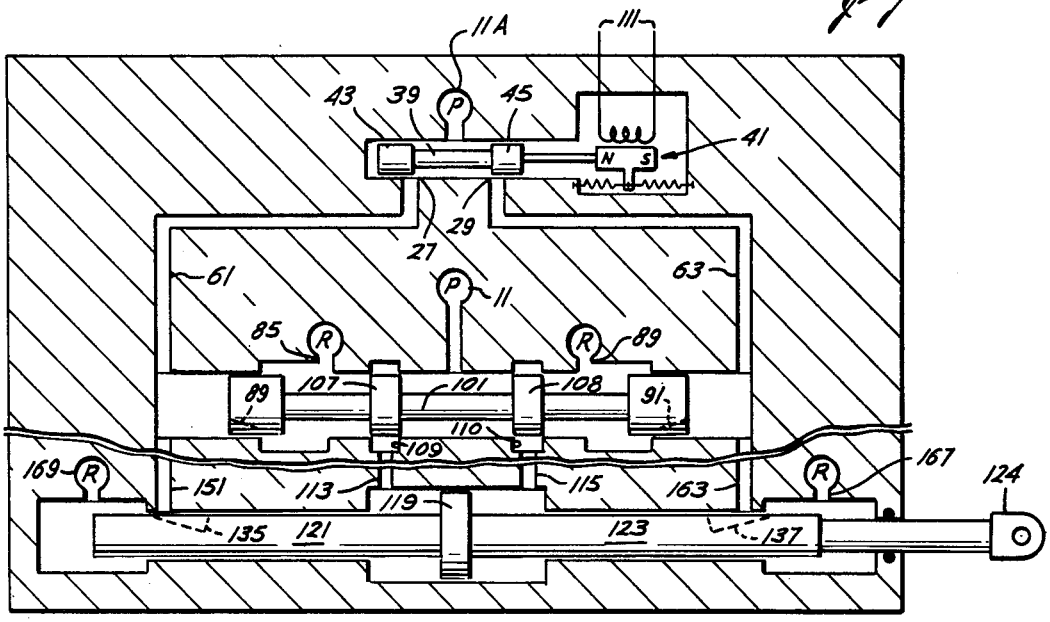
FIG. 17 is a largely schematic cross-sectional view illustrating a fluidic repeater according to an embodiment of the invention.

Referring now to FIG. 17 there is shown an embodiment to the invention, the same as that of FIG. 2 insofar as the amplifier and receiver are concerned, but employing a modified form of transmitter. Like parts are given like reference numbers. In this embodiment, motor 41 acts to move spool 39 axially in cylinder 31 to vary the position of lands 43 and 45 relative to ports 27 and 29, as in FIG. 3. However, conduit 11A connected to cylinder 31 leads to a pressure source rather than to a reservoir. The pressure in lines 61 and 63 leading to amplifier piston 101 are varied in accordance with the degree of throttling, or obstruction, produced by spool 39. Thus this is an example of control by variable obstruction of a pressure source. There is always a sufficient flow from lines 61 and 63 to the return reservoir conduit, for example 85, 89, and 167, to prevent the pressure in lines 61 and 63 from building up to supply pressure despite the throttling effect of spool 39.

The operation of the embodiment illustrated in FIG. 17 is the same as that of the embodiment illustrated by FIG. 1, in that electric signals inputted through electric motor 41 move spool 39 to vary the pressure in lines 61 and 63. This differential pressure in turn moves amplifier piston 101, causing ports 109 and 110 to be opened to the reservoir and pump pressure, respectively. The differential pressure thus applied to load piston 119 causes it to move axially, moving connected clevis 124 to actuate a load (not shown). Negative feedback, in accordance with the preferred embodiment of the invention, is effected by grooves 89 and 91 in the amplifier and by grooves 135 and 137 in the load piston. The feedback provided by these grooves limits the travel of both the amplifier and load pistons so the load pistons movement varies in an amount directly related to the amount of electrical input to motor 41. The precise relationship, linear or otherwise, between the signal strength and loan movement depends on the size and shape of the feedback grooves.

It should also be noted that, due to the fact that the end areas of piston rods 121 and 123 that are exposed to reservoir pressure are different, piston 119 comes to rest at a balance of forces, not pressures. If, however, the reservoir pressure is atmospheric pressure, then the pressure on clevis 124 will effect a precise compensation and piston 119 will come to rest with a balance of pressures in lines 113 and 115, (assuming the load on clevis 124 exerts no force when the clevis is a rest).

Figure 18:
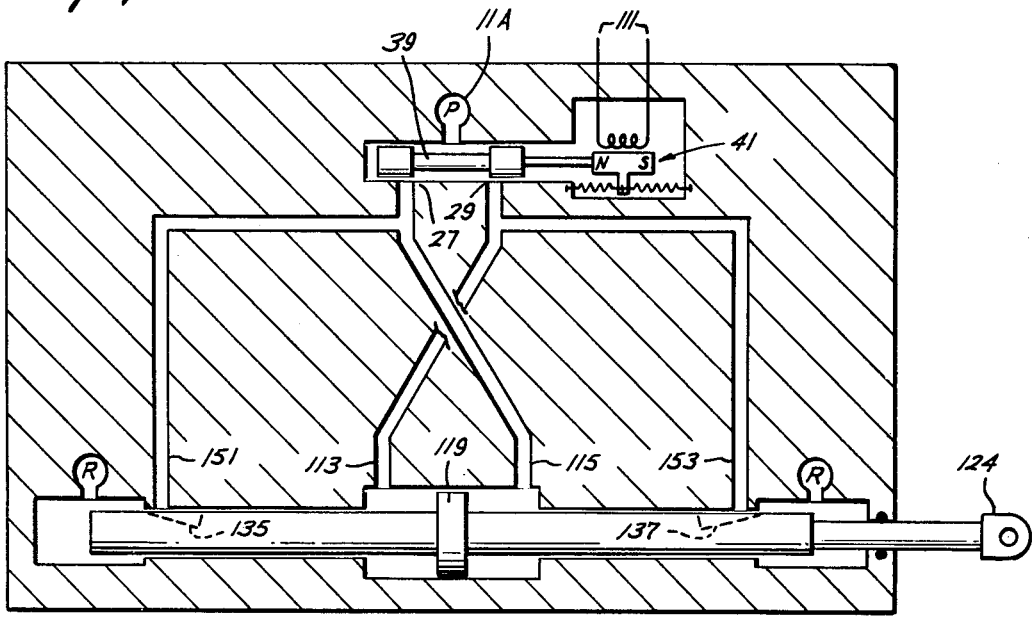
FIG. 18 is a view similar to FIG. 17 showing another embodiment.

Referring now to FIG. 18, there is shown a construction similar to that of FIG. 17 except no amplifier is employed. Like parts bear like reference numbers. It will be seen that variable pressures downstream of throttling spool 39 at port 27 and 29 are applied directly to loan piston 119 through lines 113 and 115. Negative feedback in accordance with the invention is effected by grooves 135 and 137 in the load piston. These grooves are always in position to vent some of the pressure fluid back to the reservoir so there will be no buildup of hydraulic fluid in lines 113 and 115 sufficient to lock the system.

Figure 19:
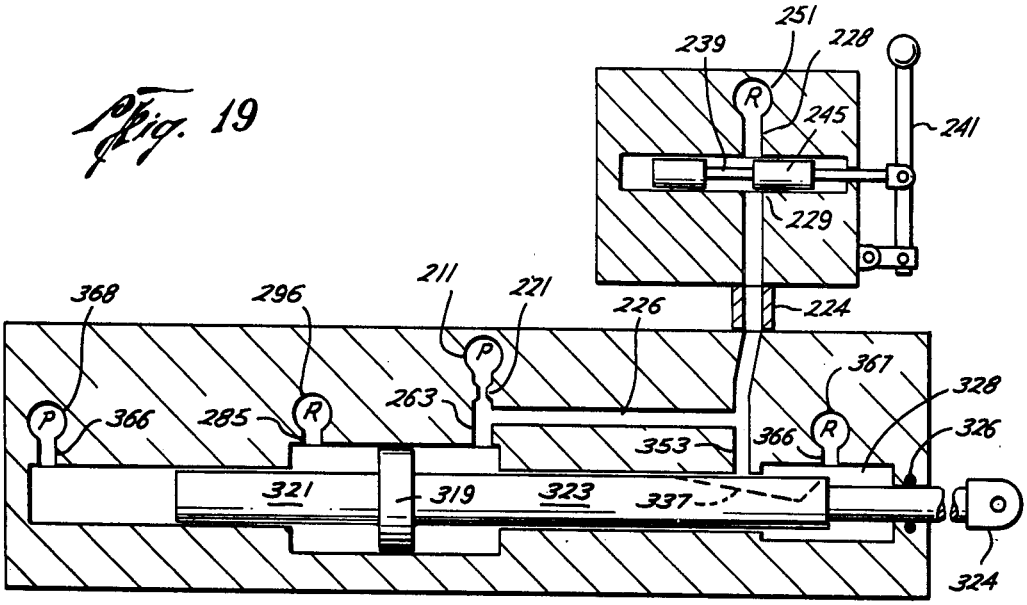
FIG. 19 is a view similar to FIG. 18 showing an embodiment of the invention using only a single pressure line for control.

Referring now to FIG. 19, there is shown another embodiment of the invention adapted for a single line connecting between the transmitter and receiver. The construction is similar to that of FIG. 18 in that no amplifier is used and similar to that of FIG. 2 in that the transmitter functions by variably venting the working fluid rather than by variably throttling it to effect pressure change. Reference numbers for parts similar to those of FIG. 2 will be employed, increased by 200.

The transmitter of FIG. 19 employs a manual input in the form of lever 241, which moves spool 239 axially. By this means single line 224 is variably vented to return-to-reservoir conduit 251. Venting varies in accordance with the position of land 245 relative to ports 228 and 229.

Load piston 319 is connected on one side by fluid passage 263 and flow restrictor 221 to conduit 221, which leads to the source of pressure fluid. Fluid passage 224 is connected to passage 263 by branch line or passage 226. The flow of fluid in this branch passage is used to vary the pressure of the fluid in passage 263 applied to one side of load piston 319. Pressure on the opposite side of piston 319 is maintained constant, e.g. by connection through passage 285 leading to a conduit connected to a reservoir. Similarly, the area at the end of piston rod 321 is connected by passage 366 to conduit 368. This conduit leads to a source of fluid pressure that may or may not be the same pressure source as is connected to conduit 211.

By varying the pressure on the variable pressure end of load piston 319 and piston 321, the pressure required on the left of load piston 319 and piston rod 321 can be adjusted to make the system responsive to movement of transmitter actuator 241.

Piston rod 323 is connected to clevis 324 for actuating a load (not shown). The aperture through which the clevis extends out of the receiver housing is sealed by O-ring 326. This prevents leakage from chamber 328 at the end of piston rod 323. The chamber is connected by passage 366 to conduit 367. This conduit leads to a reservoir. In accordance with the invention, negative feedback is achieved by the use of groove 337 in piston rod 323 that variably connects chamber 328 to fluid passage 353. Fluid passage 353 is connected to line 224 and passage 226.

When actuator 241 is moved to allow venting to increase in line 224, fluid pressure drops in passage 226 causing piston 319 to move to the right as illustrated in the drawing. Such movement causes groove 337 to also move to the right whereby only its shallow left end portion connects passage 353 to chamber 328. Venting, by passage 353, is thereby reduced, raising the pressure in passage 226 and bringing piston 319 to rest.

When activator 241 is moved to the left as shown in the drawing, venting is decreased in line 224. This results in a pressure rise in passage 226 causing piston 319 to move to the left. Such movement causes groove 337 to also move to the left whereby its deeper right ended portion connects passage 353 to chamber 328. This increases venting through passage 353, lowering pressure in passage 226 and bringing piston 319 to rest.

While the use of a single line connecting the transmitter and receiver has the advantage of structural simplicity, its operation is dependent upon the maintenance of predetermined pressure in the supply and reservoir conduits 251, 211, 368, 296, and 367. On the other hand, with the two line system previously described, only the pressure differential between the two lines is significant. Both single and dual line systems are described herein in order to illustrate the scope of the invention that is directed primarily to the negative feedback means that allows a load piston's movement to be a function of the movement of the transmitter actuator. This is true whether said actuator variably blocks a pressure source, blocks venting to a reservoir, or differentially changes the pressure in two lines.

Figure 20:
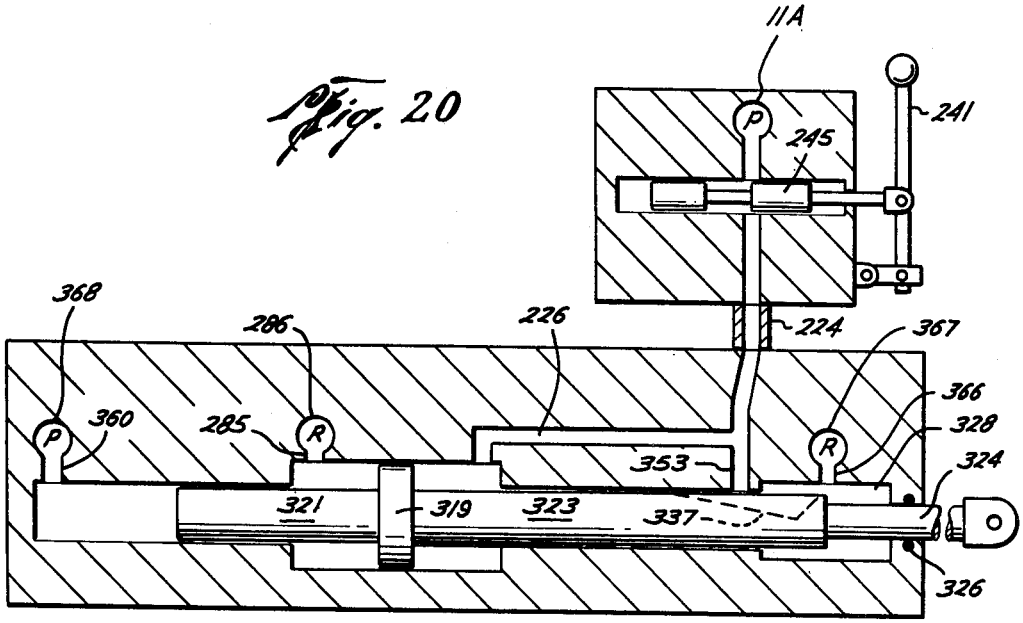
FIGS. 20 and 21 are views similar to FIG. 19 showing other embodiments of the invention using single control lines.

Referring now to FIG. 20 there is shown an embodiment to the invention that is the same as that of FIG. 19, except the transmitter functions by variable throttling as in FIG. 18 instead of by variable venting as in FIG. 19. Like parts are given like numbers to the constructions shown in FIGS. 18 and 19, whereby the operation will be obvious and repeated description rendered unnecessary.

Briefly, movement of manual actuator 241 moves variable restrictor means 245 to variably throttle pressure fluid flowing from conduit 11A to line 224 and passage 226 to the right of piston 319. This causes piston 319 to move to the right or left according to whether pressure falls or rises. Negative feedback by groove 337 causes the initial pressure change in passage 226 to be eliminated, bringing the load piston to rest in a new position.

Figure 21:
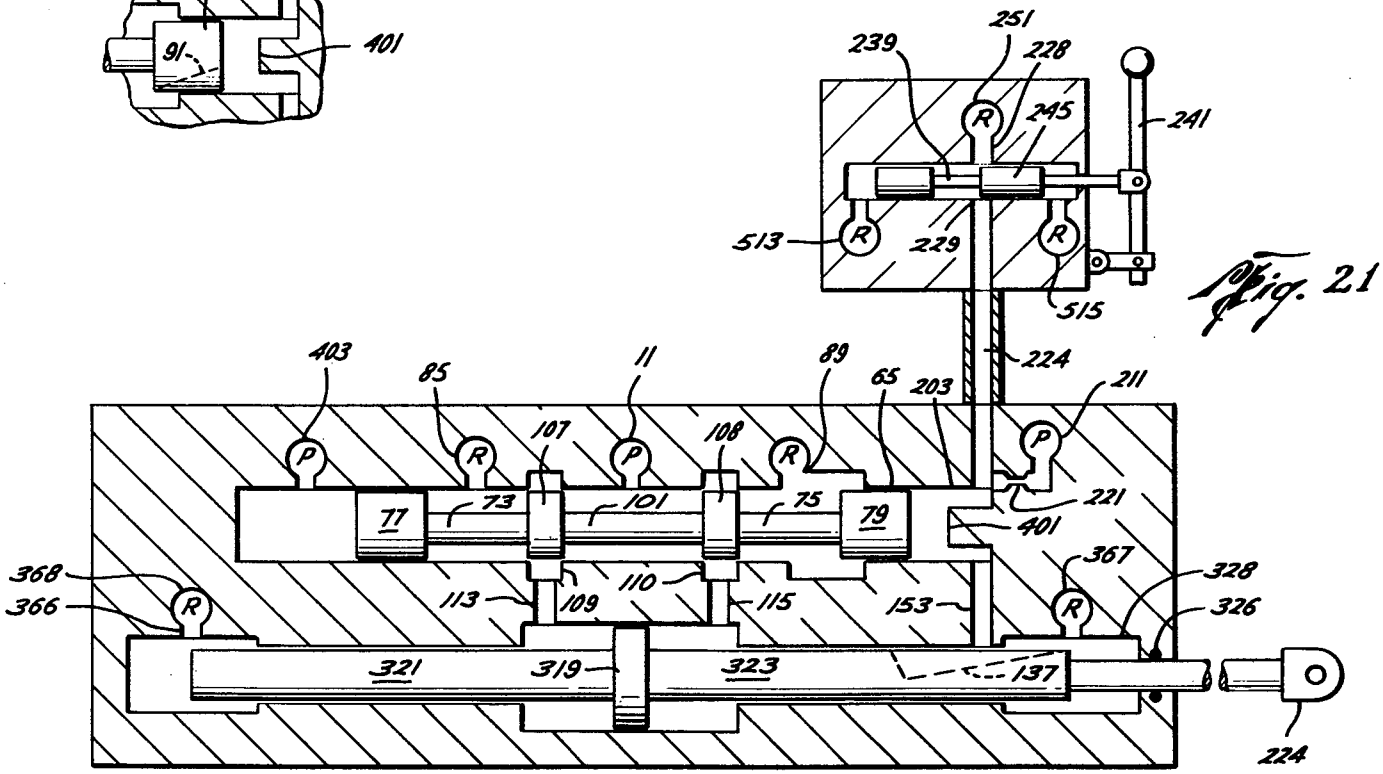

Referring to FIG. 21 there is shown an embodiment of the invention similar to that shown in FIG. 19. In this embodiment a single line is employed between transmitter and receiver and the transmitter functions by variable venting to create the desired pressure change. However, an amplifier is employed in this embodiment of the invention as was illustrated in FIGS. 2 and 17. As in FIG. 4, the amplifier, in this construction, is not provided with feedback means. Like parts are given like reference numbers.

Operationally, movement of manual actuator 241 to the left or right causes pressure to rise or fall respectively in line 224. This causes amplifier spool 101 to move to the left or right, which in turn causes load piston 319 to move to the left or right. Feedback groove 137 increases or decreases the venting of passage 153 when the piston rod 323 moves to the right or left, thereby producing negative feedback to return amplifier spool 101 to its original position and bring the load piston to rest.

It may be pointed out at this time that the feedback groove tapers in different directions according to the requirements of the particular embodiment of the invention so as to always yield negative feedback in the system. If groove 137 in FIG. 21 tapered in a direction opposite to that shown in the illustration, positive feedback would be created that would accelerate the movement of the load piston toward its limiting position in one direction or the other; instead of producing a load piston position that is a direct known function of the movement of the manual actuator.

To insure that feedback passage 153 is never blocked off completely by land 79 on the amplifier spool, a pin 401 is provided at the end of cylinder 65 in which the amplifier spool moves and limits the spools.

Figure 22:
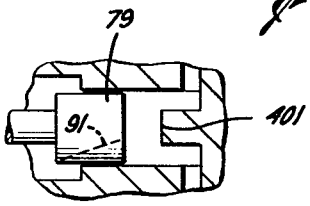
FIG. 22 is a sectional view of elements of the embodiments shown in FIGS. 20 and 21.

Referring now to FIG. 22 there is shown a variation of the amplifier piston illustrated by FIG. 21, constructed to incorporate a negative feedback groove 91. Negative feedback on the amplifier may be used in addition to or in place of negative feedback on the load piston. Preferably, negative feedback is employed with the load piston whether or not it is included in the amplifier. This prevents the load piston from tending to move toward the limit of its range of possible movement as soon as the transmitter activator is moved marginally.

Referring to FIG. 23, there is shown a further variation of the amplifier shown in FIG. 21. In the embodiment of the invention illustrated by FIG. 21 amplifier spool 101 is exposed to pressure by conduit 403 from a constant pressure source that is at a lower pressure than the pressure in conduit 211. This pressure opposes the variable pressure received by passage 203, which is responsive to the transmitter and causes the amplifier piston to move.

In the variation of the embodiment of the invention illustrated by FIG. 23, left end of amplifier spool 101 is exposed to reservoir pressure received through passage 404. A helical compression spring 405 is added to provide some of the reaction force on the amplifier spool needed to bring the spool into balance with transmitter pressure. This spring eliminates the need for an additional constant pressure source by providing a bias on piston 101. It also changes the system's response characteristics, since the reactive force provided by the spring varies with its degree of compression according to Hooke's Law. The spring is disposed concentrically around a pin 407, which centers the spring and functions like pin 401 (FIG. 21) to keep land 77 at the end of spool 101 from blocking passage 409 to conduit 404. If desired, the variation of the preferred embodiment of the invention illustrated by FIG. 23 can be used in conjunction with those novel features disclosed in FIG. 22.

Referring now to FIG. 24 there is shown a further variation of the amplifier initially illustrated in FIG. 21. In this construction, end 411 of amplifier spool 101 has a reduced end area so forces on the ends of the spool can be balanced by pressure acting on the left end of the piston from conduit 406. Conduit 406 is at the same pressure as conduits 211 and 11. This modification eliminates the need for spring 405 and provides a system having a different response characteristic because the pressure on spool end 411 remains constant. This construction can be used in combination with the feedback constructions illustrated in the embodiment of the invention shown in FIG. 22.

The embodiment of the invention illustrated in FIG. 21 can be modified for use with a variable restrictor or throttling type of transmitter. Such a variation is illustrated by FIG. 25. The operation of this type of transmitter is the same, operationally, as the embodiment shown in FIG. 20. It may be noted, however, that to prevent the possibility of hydraulic locking due to leakage around control land 245 and guide land 246 the ends of the transmitter cylinder are vented to reservoir pressure by conduits 513 and 515. A similar construction is used in the embodiment of the invention illustrated in FIG. 21. This variation of the preferred embodiment of the invention's transmitter illustrated by FIG. 25 can be used with any of the amplifier constructions illustrated by FIGS. 21 through 24.

Figures 26, 28, 29:
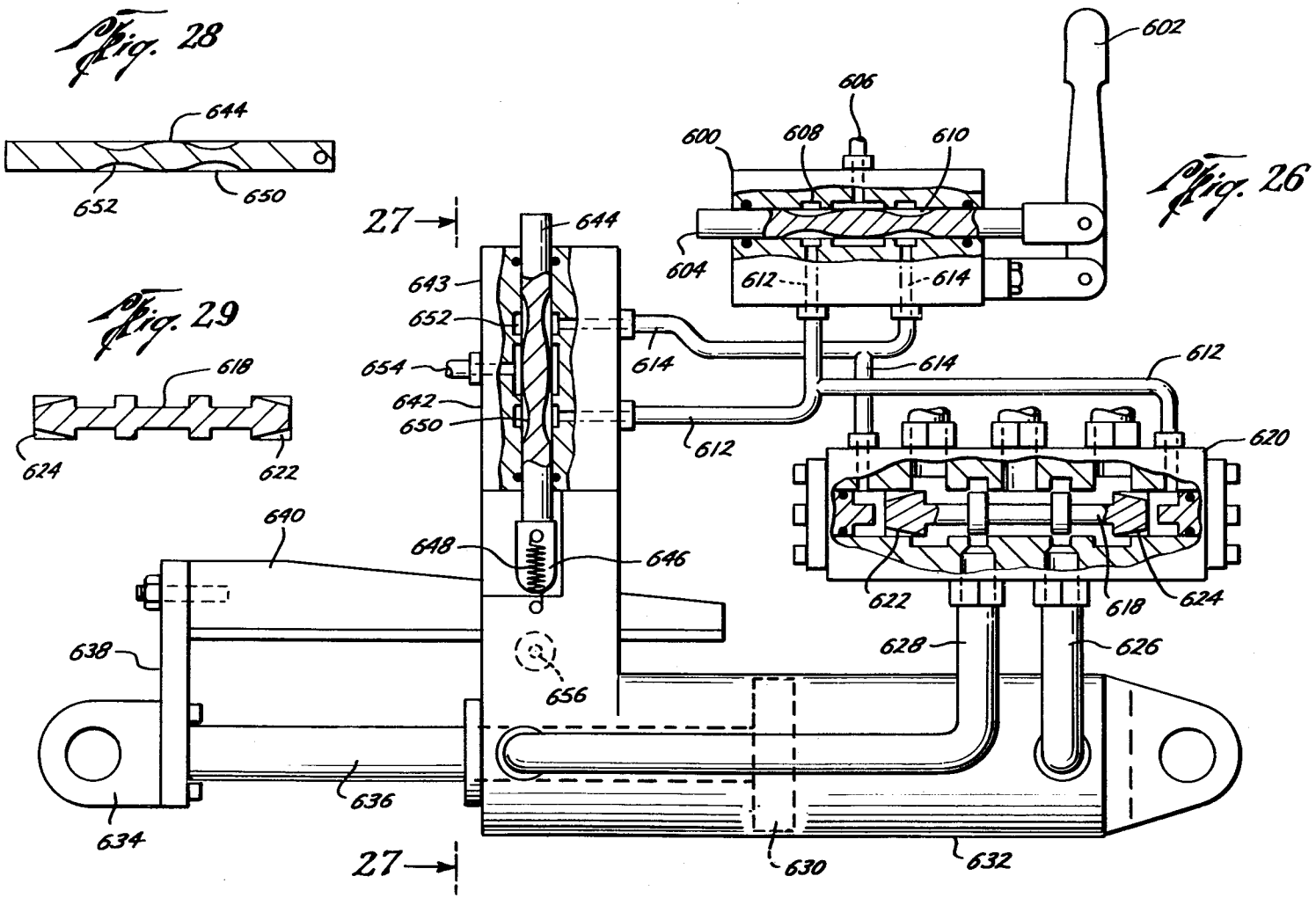
FIG. 26 is a fragmentary sectional view of a commercial embodiment of the invention.
FIGS. 28 and 29 are sectional views of valves used in the invention's embodiment depicted in FIG. 26.

FIG. 26 illustrates a commercial embodiment of the invention. In this embodiment transmitter 600 has a lever 602 connected to grooved valve rod 604 and adapted to move the valve rod to variably obstruct the flow of fluid from pressure conduit 606 through grooves 608 and 610, thus creating a pressure differential between lines 612 and 614. Differential pressure moves spool valve 618 in amplifier 620. Spool valve 618 is supplied with feedback grooves 622 and 624. Movement of the amplifier's spool valve creates a pressure imbalance between conduits 626 and 628. This imbalance of forces moves piston 630 in load cylinder 632 as has been described earlier. Piston 630 is connected to clevis 634 by rod 636. The clevis is attached to a plate 638, which is provided with a cam 640 used to actuate load feedback means 642. Load feedback means 642 has a body 643 in which is mounted a grooved valve 644. The valve is attached to a wheel 646 and constrained by spring 648 to move to a position dependent on the position of cam 640 and thus on the position of piston 630 and clevis 634. As the valve's position is varied by movement of load piston 630, lines 612 and 614 are variably vented by grooves 650 and 652 in valve rod 644 to return line 654. This venting tends to reduce the pressure imbalance acting on the amplifier's spool valve causing it to return to a neutral position and stopping movement of the load piston. Hence the clevis and the load attached to it will come to rest at a position dependent on the displaced position of the transmitter's control lever 602.

In this commercial embodiment, the amplifier spool valve and load piston both incorporate feedback means taught by the preferred embodiment of the invention. These feedback means are shown working in cooperation to produce a final clevis position that is a known function of the control lever's position. Also, since the load piston has unequal areas exposed to the differential pressures from conduits 626 and 628, the load piston will come to rest at a balance of forces on its two sides rather than at a balance of pressures in lines 626 and 628.

Figures 27, 30, 31:
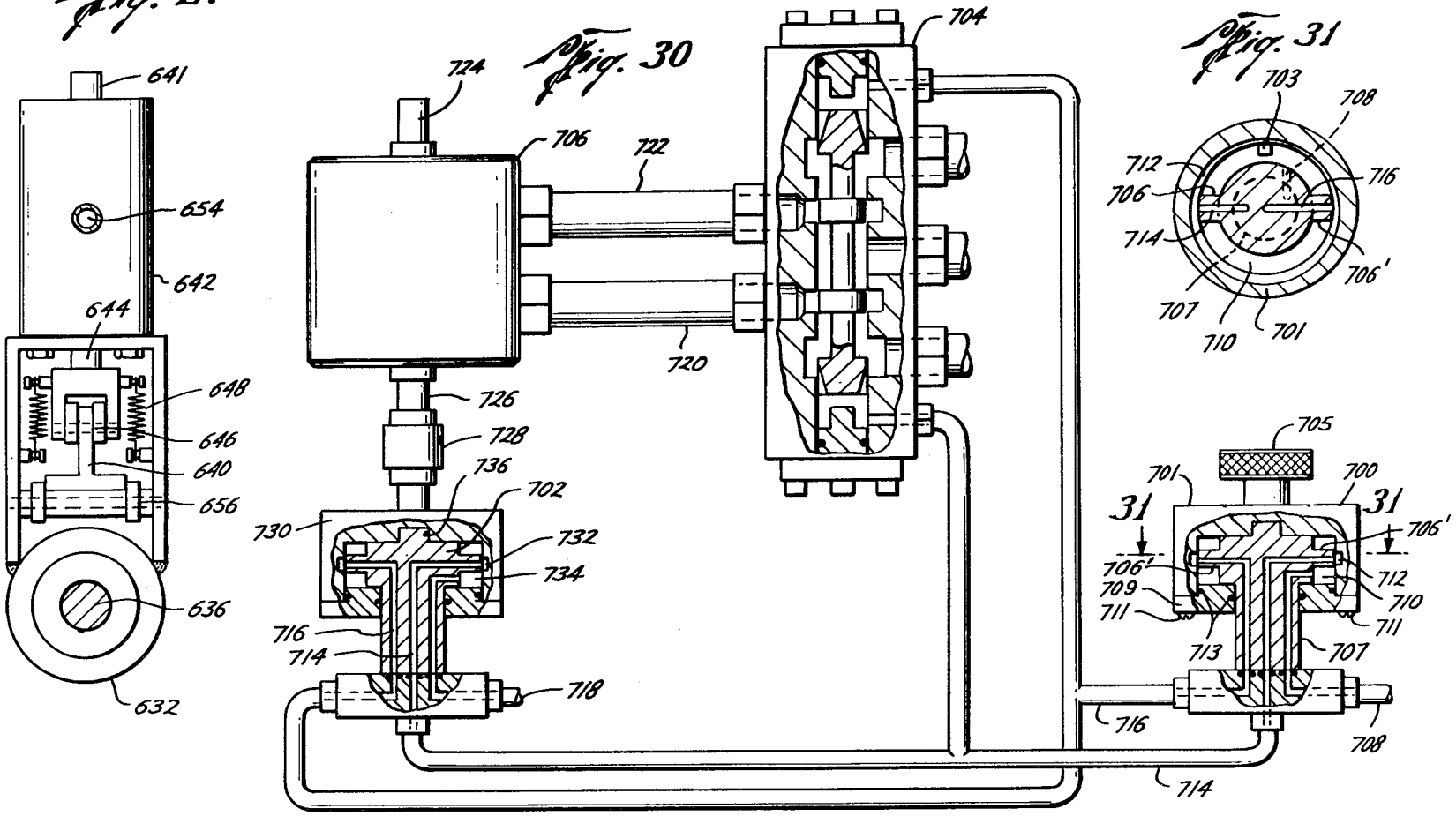
FIG. 27 is an elevational view of a section of FIG. 26 taken along lines 27—27.
FIG. 30 is a partially sectional view of another commercial embodiment of the invention.
FIG. 31 is a sectional view of the transmitter illustrated in FIG. 30 taken along lines 31—31.

FIG. 27 shows an isometric view of load feedback means 642 along lines 27—27 of FIG. 26. Springs 648 are shown biasing roller 646, which is attached to valve rod 644, into contact with cam 640. The cam which is shown as being "T" shaped in the illustration, rests on lower roller 656, which is a guide roller.

FIGS. 28 and 29 illustrate sectional views of the feedback valve rod and amplifier spool valve, respectively, clearly showing the feedback grooves taught by the preferred embodiment of the invention.

FIG. 30 illustrates a second commercial embodiment of the invention. In this embodiment a rotary transmitter 700 and a rotary load feedback means 702 operate with an amplifier-feedback 704, which is substantially the same as amplifier 620 illustrated and described in FIG. 26, and hydraulic motor 706 to produce a rotary fluidic servo system. Motor 706 may be, for example, a Hydreco model 2M000B2A1 hydraulic motor suitably modified to operate with a double ended output shaft (see accompanying description thereof).

Transmitter 700 has a rotor 701 rotatable about a head 702. The rotor is pivotally mounted on pin 704 and shaft 707. The head has two arms 706 and 706' extending radially into contact with the inner periphery of the rotor. The rotor is constrained by stop 703 (see FIG. 31) engaging arm 706 or arm 706' to be rotatable by wheel 705 through slightly less than 180 degrees. The inner periphery of rotor 701 is provided with an eccentric circular groove 712. Bottom plate 709 is affixed to head 701 with screws 711. Seal rings 713 seal off space 710 between the rotor 701 and head 702 of the transmitter.

Fluid under pressure is introduced from a source, not shown, to conduit 708. This pressurizes annular space 710 that is in fluid communication with eccentric groove 712. This eccentric groove, which is clearly illustrated in FIG. 31, differentially pressurizes conduits 714 and 716 that extend to the ends of arms 706 and 706' and are connected to the control inputs of fluidic amplifier 704. The bottom of groove 712 is circular when viewed in plan, as in FIG. 31, the circle being slightly eccentric to the axis about which the rotor rotates, i.e. the axis of pin 704 and shaft 707. The center of this circle is slightly displaced from the rotor's axis along the line joining the rotor axis and the middle of stop 703 in a direction away from pin 703. Adjacent pin 703 the groove is of minimum radial depth; diametrically opposite from pin 703 the groove is of maximum depth. As shown in FIG. 30 the width of the groove is uniform and of less extent than the height of the arms 706 and 706' so that fluid leaving fluid passages 714 and 716 (see FIG. 31) must travel a short distance along the groove before it can enter space 710, and in the process the fluid flow is throttled according to the groove's depth.

As conduits 714 and 716 are differentially pressurized by fluid flowing under pressure through their respective sections of groove 712, amplifier 704 acts to control hydraulic motor 706 by establishing differential pressures in output conduits 720 and 722. Motor 706 has a two ended output shaft. End 724 is connected to a load or indicator as may be appropriate. End 726 is connected through coupling 728 to the rotary head 730 of load feedback means 702. Feedback 702 is structurally identical to transmitter 700. In the load feedback means differentially pressurized conduits 714 and 718 are variably vented via eccentric groove 732 through communicating chamber 734 to conduit 713, which is connected to a fluid reservoir, not shown. Variable venting tends to equalize pressures in conduits 714 and 716, causing the rotation of shaft 724 of hydraulic motor 706' to cease at a position that is a known function of the rotational displacement of transmitter 700's control knob 705. Stop 703 is adapted to prevent the rotation of eccentric groove 712 in head 701 past its point of greatest difference in flow with respect to the conduits opening into said eccentric groove from control head 707. Stop 736 performs the same function with respect to venting these conduits in responder 702.

FIG. 31 is a sectional view of transmitter 700 taken along line 31—31. It illustrates the fluid communication of conduits 714 and 716 with eccentric groove 712 and shows the differential variable obstruction provided by the groove between conduit 708 and each of conduits 714 and 716. The geometry of this eccentric groove may be varied in both the transmitter and the responder to obtain a desired feedback function between the transmitter and the load in the illustrated servo system.

Although certain operational and preferred embodiments of the invention have been disclosed and described by this application, many modifications incorporating the advantageous features of this invention will immediately be apparent to those skilled in the art of fluidic control engineering. Accordingly, the invention is not to be limited to the specific embodiments shown and described, but only as set forth by the appended claims.

I claim:

1. Fluidic repeater comprising:

a fluid passage for conveying pressurized fluid;

first source connection means for connecting said passage to source of pressurized fluid;

transmitter means, including a variably-positionable fluid-flow obstructor, for variably obstructing the flow of fluid from said source connection means to said fluid passage according to the position of said obstructor over a continous range of positions including a first position and a second position and a plurality of positions in between said first and second positions:

a responder having components movable with respect to one another, said components including a primary cylinder and a primary piston axially-movably disposed within said primary cylinder, said passage being connected to one end of said primary cylinder such that the fluid within said passage exerts a first force against the end of said primary piston adjacent to said one end of said primary cylinder;

opposition means for exerting a second force upon said primary piston in opposition to said first force, the total force exerted by said opposition means being independent of the position of said transmitter means obstructor;

feedback means for variably venting fluid from said passage to a reservoir of fluid at lower pressure than said passage at a point downstream from said transmitter means obstructor, the extent of venting by said feedback means being variable according to the respective positions of the responder components, whereby upon a change in the relative position of said responder components due to change in pressure in said passage effected by change of position of said transmitter, said responder feeds back to said passage a counteracting change in pressure;

said transmitter and feedback means controlling the pressure in said passage, said pressure in said passage being free of dither 50 that said responder will come to rest when said obstructor of the transmitter is at rest.

2. Fluidic repeater according to claim 1 wherein said responder primary cylinder includes an annular groove having reservoir connection means for connecting said primary cylinder to the reservoir, and said feedback means includes a feedback passage in said primary cylinder which passage has a variable cross-section taken in planes transverse to the direction of fluid flow through said feedback passage and which feedback passage is contiguous with and directly communicates with said primary cylinder groove such that fluid flows at variable rate from said one end of said primary cylinder through said feedback passage and into said primary cylinder annular groove.

3. Fluidic repeater according to claim 1 wherein said components of said responder further include a secondary cylinder and a secondary piston axially-movably disposed in said secondary cylinder, and said responder further includes first valve means, actuated by said primary piston, for controlling fluid supply from a source of pressurized fluid to opposite sides of said secondary piston to cause movement of said secondary piston in response to movement of said primary piston.

4. Fluidic repeater according to claim 1, said transmitter means being upstream of said responder, said feedback means being downstream of said responder, said transmitter means including operator means for positioning said obstructor thereof, the position of said obstructor being single valued for each position of the operator means, said responder having a certain position in which said primary piston is disposed in between the ends of said cylinder, said certain position of the responder corresponding to a certain position of the transmitter obstructor in that the responder piston assumes its said certain position when the transmitter obstructor is in its said certain position, said responder piston being movable from its said certain position in either directiion depending upon the direction of movement of the transmitter obstructor from its said certain position, whereby said certain positions of the responder piston and transmitter obstructor constitute mid-positions, said transmitter means when its obstructor is in its said mid-position passing sufficient fluid to said passage to create a fluid pressure on said responder balancing that of said opposition means despite said feedback means venting fluid from said passage when said responder piston is in its said mid-position.

5. Fluidic repeater comprising:

a fluid passage for conveying pressurized fluid;

first source connection means for connecting said passage to a source of pressurized fluid;

transmitter means, including a variably-positionable fluid-flow obstructor, for variably obstructing the flow of fluid from said source connection means to said fluid passage according to the position of said obstructor;

a responder having components movable with respect to one another, said components including a primary cylinder and a primary piston axially-movably disposed within said primary cylinder, said passage being connected to one end of said primary cylinder such that the fluid within said passage exerts a first force against the end of said primary piston adjacent to said one end of said primary cylinder;

opposition means for exerting a second force upon said primary piston in opposition to said first force, the total force exerted by said opposition means being independent of the position of said transmitter means obstructor;

feedback means for variably venting fluid from said passage to a reservoir of fluid at lower pressure than said passage at a point downstream from said transmitter means obstructor, the extent of venting by said feedback means being variable according to the respective positions of the responder components, whereby upon change in the relative position of said responder components due to change in pressure in said passage effected by change of position of said transmitter, said responder feeds back to said passage a counteracting change in pressure;

said components of said responder further including a secondary cylinder and a secondary piston axially-movably disposed in said secondary cylinder, and said responder further including first valve means, actuated by said primary piston, for controlling fluid supply from a source of pressurized fluid to opposite sides of said secondary piston to cause movement of said secondary piston in response to movement of said primary piston;

wherein said feedback means includes valve means, connected to and actuated by said secondary piston, for variably venting fluid from said passage to the reservoir according to the position of said secondary piston with respect to said secondary cylinder.

6. Fluidic repeater according to claim 5 wherein said feedback means includes a feedback means passage in the surface of said responder secondary piston.

7. Fluidic repeater according to claim 5 wherein said feedback means further includes a variable cross section passage in the surface of said primary piston.

8. Fluidic repeater according to claim 7 wherein said primary cylinder includes an annular groove having reservoir connection means for connecting said primary cylinder to the reservoir, and said feedback means passage communicates with said primary cylinder groove such that fluid flows at variable rate from said one end of said primary cylinder, through said feedback means passage and into said primary cylinder annular groove.

9. Fluidic repeater according to claim 8 wherein the force exerted by said opposition means is substantially constant.

10. Fluidic repeater according to claim 8 wherein the force exerted by said opposition means is created by fluid pressure.

11. Fluidic repeater according to claim 10 wherein said opposition means includes a third cylinder and a third piston axially-movably disposed in said third cylinder, one end of said third piston being connected to said primary piston, there being a space between the other end of said third piston and the end of said third cylinder adjacent thereto, said opposition means further including second source connection means for connecting said space to a source of pressurized fluid.

12. Fluidic repeater according to claim 11 wherein said third cylinder has smaller cross sectional area than said first cylinder and said first source connection means and said second source connection means connect to the same source.

13. Fluidic repeater according to claim 5 wherein the force exerted by said opposition means is substantially constant.

14. Fluidic repeater according to claim 5 wherein the force exerted by said opposition means is created by fluid pressure.

15. Fluidic repeater according to claim 14 wherein said opposition means includes a third cylinder and a third piston axially-movably disposed in said third cylinder, one end of said third piston being connected to said primary piston, there being a space between the other end of said third piston and the end of said third cylinder adjacent thereto, said opposition means further including second source connection means for connecting said space to a source of pressurized fluid.

16. Fluidic repeater comprising:

a fluid passage for conveying pressurized fluid;

transmitter means, including a variably-positionable fluid-flow obstructor, for variably obstructing the flow of fluid from said source connection means to said fluid passage according to the position of said obstructor;

a responder having components movable with respect to one another, said components including a primary cylinder and a primary piston axially-movably disposed within said primary cylinder, said passage being connected to one end of said primary cylinder such that the fluid within said passage exerts a first force against the end of said primary piston adjacent to said one end of said primary cylinder;

opposition means for exerting a second force upon said primary piston in opposition to said first force, the total force exerted by said opposition means being independent of the position of said transmitter means obstructor;

feedback means for variably venting fluid from said passage to a reservoir of fluid at lower pressure than said passage at a point downstream from said transmitter means obstructor, the extent of venting by said feedback means being variable according to the respective positions of the responder components, whereby upon change in the relative position of said responder components due to change in pressure in said passage effected by change of position of said transmitter, said responder feeds back to said passage a counteracting change in pressure;

the force exerted by said opposition means being created by fluid pressure;

said opposition means including a third cylinder and a third piston axially-movably disposed in said third cylinder, one end of said third piston being connected to said primary piston, there being a space between the other end of said third piston and the end of said third cylinder adjacent thereto, and said opposition means further including second source connection means for connecting said space to a source of pressurized fluid;

wherein said third cylinder has smaller cross sectional area than said first cylinder and said first source connection means and said second source connection means connect to the same source.

17. Fluidic repeater comprising:

a fluid passage for conveying pressurized fluid;

first source connection means for connecting said passage to a source of pressurized fluid;

transmitter means, including a variably-positionable fluid-flow obstructor, for variably obstructing the flow of fluid from said source connection means to said fluid passage according to the position of said obstructor;

a responder including a primary cylinder and a primary piston axially-movably disposed within said primary cylinder, said passage being connected to one end of said primary cylinder such that the fluid within said passage exerts a first force against the end of said primary piston adjacent to said one end of said primary cylinder;

opposition means for exerting a second force upon said primary piston in opposition to said first force, the total force exerted by said opposition means being independent of the position of said transmitter means obstructor;

feedback means for variably venting fluid from said passage to a reservoir of fluid at lower pressure than said passage at a point downstream from said transmitter means obstructor, the extent of venting by said feedback means being variable according to the position of said primary piston with respect to said primary cylinder, said responder further including a secondary cylinder and a secondary piston axially movably disposed in said secondary cylinder, and said responder further including first valve means, actuated by said primary piston, for controlling fluid supply from a source of pressurized fluid to opposite sides of said secondary piston to cause movement of said secondary piston in response to movement of said primary piston, wherein said vent means includes valve means, connected to and actuated by said secondary piston, for variably venting fluid from said passage to the reservoir according to the position of said secondary piston with respect to said secondary cylinder.

18. Fluidic repeater according to claim 17 wherein said feedback means further includes a variable cross section passage in the surface of said primary piston.

19. Fluidic repeater according to claim 18 wherein said primary cylinder includes an annular groove having reservoir connection means for connecting said primary cylinder to the reservoir, and said feedback means passage communicates with said primary cylinder groove such that fluid flows at variable rate from said one end of said primary cylinder, through said feedback means passage and into said primary cylinder annular groove.

20. Fluidic repeater comprising:

a fluid passage for conveying pressurized fluid;

first source connection means for connecting said passage to a source of pressurized fluid;

transmitter means, including a variably-positionable fluid-flow obstructor, for variably obstructing the flow of fluid from said source connection means to said fluid passage according to the position of said obstructor;

a responder including a primary cylinder and a primary piston axially-movably disposed within said primary cylinder, said passage being connected to one end of said primary cylinder such that the fluid within said passage exerts a first force against the end of said primary piston adjacent to said one end of said primary cylinder;

opposition means for exerting a second force upon said primary piston in opposition to said first force, the total force exerted by said opposition means being independent of the position of said transmitter means obstructor; and vent means for variably venting fluid from said passage to a reservoir of fluid at lower pressure than said passage at a point downstream from said transmitter means obstructor, the extent of venting by said feedback means being variable according to the position of said primary piston with respect to said primary cylinder, wherein the force exerted by said opposition means is created by fluid pressure, and wherein said opposition means includes a third cylinder and third piston axially-movably disposed in said third cylinder, one end of said third piston being connected to said primary piston, there being a space between the other end of said third piston and the end of said third cylinder adjacent thereto, said opposition means further including second source connection means for connecting said space to a source of pressurized fluid.

21. Fluidic repeater according to claim 20 wherein said third cylinder has smaller cross sectional area than said first cylinder and said first source connection means and said second source connection means connect to the same source.

* * * * *

UNITED STATES PATENT AND TRADEMARK OFFICE

CERTIFICATE OF CORRECTION

PATENT NO. : 4,152,971

DATED : May 8, 1979

INVENTOR(S) : Willie Burt Leonard

It is certified that error appears in the above-identified patent and that said Letters Patent are hereby corrected as shown below:

Column 1, line 56: After "the", change "referred" to -- preferred --.

Column 3, line 14: After "ports", change "this" to -- , thus --.

Column 3, line 33: After "piston", delete "77" and insert -- 67 --.

Column 4, line 43: After "closure", change ". The" to -- , the --.

Column 7, line 19: After "further", delete "embodiment" and insert -- movement --.

Column 7, line 35: At the beginning of the line, change "which 243" to -- 243 which --.

Column 8, line 14: After "plugs", change "390" to -- 39C --.

Column 8, line 15: After "No", change "loas" to -- load --.

Column 8, line 69: After "to", change "affect" to -- effect --.

Column 9, line 15: After "Thus", insert a comma (,).

UNITED STATES PATENT AND TRADEMARK OFFICE

CERTIFICATE OF CORRECTION

PATENT NO. : 4,152,971

DATED : May 8, 1979

INVENTOR(S) : Willie Burt Leonard

It is certified that error appears in the above-identified patent and that said Letters Patent are hereby corrected as shown below:

Column 9, line 50: After "is", change "a" to --at--.

Column 9, line 56: After "to", change "loan" to --load--。

Column 10, line 10: After "conduit", change "221" to -211-.

Column 11, line 46: After "other", change the semicolon (;) to a comma (,).

Column 10, line 47: After "When", change "activator" to --actuator--。

Column 11, line 52: After "the", delete "spools" and insert --spool's travel--.

Column 13, line 35: After"an", change "amplifier-feedback" to --amplifier responder--。

Column 15, line 21: After "dither", change "50" to -so-.

Signed and Sealed this

*Eighteenth* Day of *March 1980*

[SEAL]

*Attest:*

SIDNEY A. DIAMOND

*Attesting Officer*

*Commissioner of Patents and Trademarks*